US005707259A

United States Patent [19]

Ishizuka et al.

[11] Patent Number: 5,707,259

[45] Date of Patent: Jan. 13, 1998

[54] FEMALE TERMINAL

[75] Inventors: Shigeo Ishizuka; Isao Kameyama, both of Shizuoka-ken, Japan

[73] Assignee: Yazaki Corporation, Tokyo, Japan

[21] Appl. No.: 681,467

[22] Filed: Jul. 23, 1996

[30] Foreign Application Priority Data

Jul. 24, 1995 [JP] Japan ..... 7-187173

[51] Int. Cl.[6] ..... H01R 11/22

[52] U.S. Cl. ..... 439/852; 439/862

[58] Field of Search ..... 439/842–862

[56] References Cited

U.S. PATENT DOCUMENTS 5,540,603 7/1996 Fujiwara ..... 439/851

FOREIGN PATENT DOCUMENTS 5-205804 8/1993 Japan .

*Primary Examiner*—Neil Abrams
*Assistant Examiner*—Brian J. Biggi
*Attorney, Agent, or Firm*—Finnegan, Henderson, Farabow, Garrett & Dunner, L.L.P.

[57] ABSTRACT

A female terminal includes a hollow contact portion of a substantially quadrangular cross-section for receiving a male terminal through an opening formed in a front end thereof, so as to establish an electrical connection between the male terminal and the female terminal, and a resilient contact piece, formed in the hollow contact portion by folding a tip portion of the bottom plate portion of the hollow contact portion, for biasing the male terminal toward the roof plate portion of the hollow. The resilient contact piece has a first piece portion which extends from the front end of the hollow contact portion so as to be inclined upwards toward the roof plate portion. The female terminal also includes a plurality of protruding portions extending from the bottom plate portion toward the roof plate portion, for supporting thereon the first piece portion while maintaining the elastic deformation of the first piece portion when an excessive force is applied to the first piece portion.

4 Claims, 3 Drawing Sheets

FEMALE TERMINAL

BACKGROUND OF THE INVENTION

1. Field of the Invention

The present invention relates to a female terminal having a resilient contact piece in a hollow contact portion of a substantially quadrangular cross-section.

2. Description of the Related Art

A female terminal typically comprises an electric hollow contact portion of a quadrangular cross-section having a front opening, through which a male terminal is inserted into the contact portion, a resilient contact piece folded inwardly at the tip portion of a bottom plate of the electric contact portion, and a protruding portion formed on the inner wall of the electric contact portion for restricting the deflection of the resilient contact piece. The rear portion of the electric contact portion is formed with an insulator clamping portion, by which a wire harness is clamped to be contacted thereto, and with an electric conductor clamping portion, by which an electric conductor is clamped to be connected thereto.

When a male terminal is not inserted into the electric contact portion, the resilient contact piece is apart from the protruding portion. From this condition, when a male terminal is inserted into the electric contact portion, the resilient contact piece is bent to approach the outer periphery of the protruding portion. In this condition, there is a slight gap between the resilient contact piece and the outer periphery of the protruding portion, and the male terminal is pressed against the inner wall of the electric contact portion by means of the resilient contact piece. When the resilient contact piece is excessively bent, it is designed to contact the outer periphery of the protruding portion to prevent excessive displacement.

In addition to the male terminal, a probe such as a tester for testing the conducting state of the female terminal, or an extracting tool for extracting the female terminal from a terminal chamber of a connector, are often inserted into the electric contact portion of the female terminal. In such a case, when the probe or the extracting tool contacts a portion around the bent portion of the resilient contact piece, the resilient contact piece may deform due to the gap between the resilient contact piece and the protruding portion. In this case, the resilient contact piece is plastic-deformed to cause so-called permanent set in fatigue (settling) which loses its elasticity.

When the elasticity of the resilient contact piece is lost, it is not possible to press the male terminal against the inner wall of the electric contact portion to hold the male terminal, so that a gap between the male terminal and the inner wall of the electric contact portion may be formed to cause a bad conducting state.

In order to prevent the deformation of a resilient contact piece so as not to lose its elasticity, an improved female terminal has been proposed in Japanese Patent Laid-Open No. 5-205804 for a patent application which was filed by the assignee of the present invention (the disclosure of which is hereby incorporated by reference herein). In this female terminal, a protruding portion is formed with a first piece portion so that a first piece portion of a resilient contact piece contacts the first piece portion of the protruding portion in the range of the elastic deformation of the resilient contact piece while the deflection of the resilient contact piece is restricted by the protruding portion.

In this female terminal, when a probe of a tester or an extracting tool is inserted into an electric contact portion so as to press the first piece portion of the resilient contact piece against the first piece portion of the protruding portion, the first piece portion of the resilient contact piece contacts the first piece portion of the protruding portion. Since the pressing force caused by the probe or the extracting tool is applied to the resilient contact piece supported on the protruding portion, it is possible to prevent the resilient contact piece from being plastic-deformed to cause the permanent set in fatigue (settling). Therefore, the resilient contact piece does not lose its elasticity, so that it is possible to elastically hold the male terminal in the electric contact portion to prevent a bad conducting state.

In this female terminal, when the probe or the extracting tool contacts the tip portion of the resilient contact piece, the first piece portion of the resilient contact piece can closely contact the first piece portion of the protruding portion while maintaining the elastic deformation of the resilient contact piece, so as to surely prevent the resilient contact piece from being excessively deformed. However, if the middle portion of the first piece portion of the resilient contact piece is prized by the extracting tool, the first piece portion of the resilient contact piece may be deformed. That is, a gap serving as a space for deflection is formed between the resilient contact piece and the protruding portion so that the resilient contact piece can produce a suitable contact pressure. If the extracting tool contacts and prizes the middle portion of the first piece portion of the resilient contact piece, the protruding portion can not closely contact the first piece portion of the resilient contact piece, so that the middle portion of the first piece portion of the resilient contact piece may be deformed.

In addition, when this female terminal is formed with the protruding portion, the width of the protruding portion must be sufficiently wide. Therefore, this female terminal is not practical in a small female terminal.

SUMMARY OF THE INVENTION

It is therefore an object of the present invention to eliminate the aforementioned problems and to provide a female terminal which is not deformed if the middle portion of a resilient contact piece is prized and which can be molded if it is small.

In order to accomplish the aforementioned and other objects, according to one aspect of the present invention, a female terminal comprises: a hollow contact portion of a substantially quadrangular cross-section for receiving a male terminal through an opening formed in a front end thereof, so as to establish an electrical connection between the male terminal and the female terminal, the hollow contact portion having a roof plate portion and a bottom plate portion; a resilient contact piece, formed in the hollow contact portion by folding a tip portion of the bottom plate portion, for biasing the male terminal toward the roof plate portion, the resilient contact piece having a first piece portion which extends from the front end so as to be inclined upwards toward the roof plate portion; and a plurality of protruding portions extending from the bottom plate portion toward the roof plate portion, for supporting thereon the first piece portion while maintaining the elastic deformation of the first piece portion when an excessive force is applied to the first piece portion.

According to this female terminal, when the middle portion of the first piece portion of the resilient contact piece is prized by an extracting tool or the like, the first piece portion is supported on the protruding portions while the elastic deformation of the resilient deformation is maintained, so that it is possible to prevent the plastic deformation of the resilient contact piece. Since the first piece portion can be returned to its original position when the extracting tool or the like is removed from the hollow contact portion, it is possible to elastically hold the male terminal in the hollow contact portion when the male terminal is inserted into the hollow contact portion after the extracting tool or the like is removed. In addition, since the protruding portions do not contact the whole lower surface of the first contact piece, it is possible to mold a small female terminal.

The plurality of protruding portions may be so arranged as to be apart from each other at regular intervals in a longitudinal direction of the female terminal, each of the plurality of protruding portions having a height set in accordance with the inclination of the first piece portion.

In this case, since the heights of the protruding portions are set in accordance with the inclination of the first piece portion, the first piece portion is supported on the protruding portions while maintaining the naturally bent state.

Each of the plurality of protruding portions may be formed by bending a portion cut out of the bottom plate portion in a direction substantially perpendicular to the bottom plate portion.

In this case, since the protruding portions are formed by folding a cut-out portion, it is possible to decrease the manufacturing cost.

The resilient contact piece may have a second piece portion which extends from the tip of the first piece portion so as to be inclined downwards toward the bottom plate portion.

BRIEF DESCRIPTION OF THE DRAWINGS

The present invention will be understood more fully from the detailed description given herebelow and from the accompanying drawings of the preferred embodiment of the invention. However, the drawings are not intended to imply limitation of the invention to this specific embodiment, but are for explanation and understanding only.

In the drawings.

DESCRIPTION OF THE PREFERRED EMBODIMENT

Figure 1:
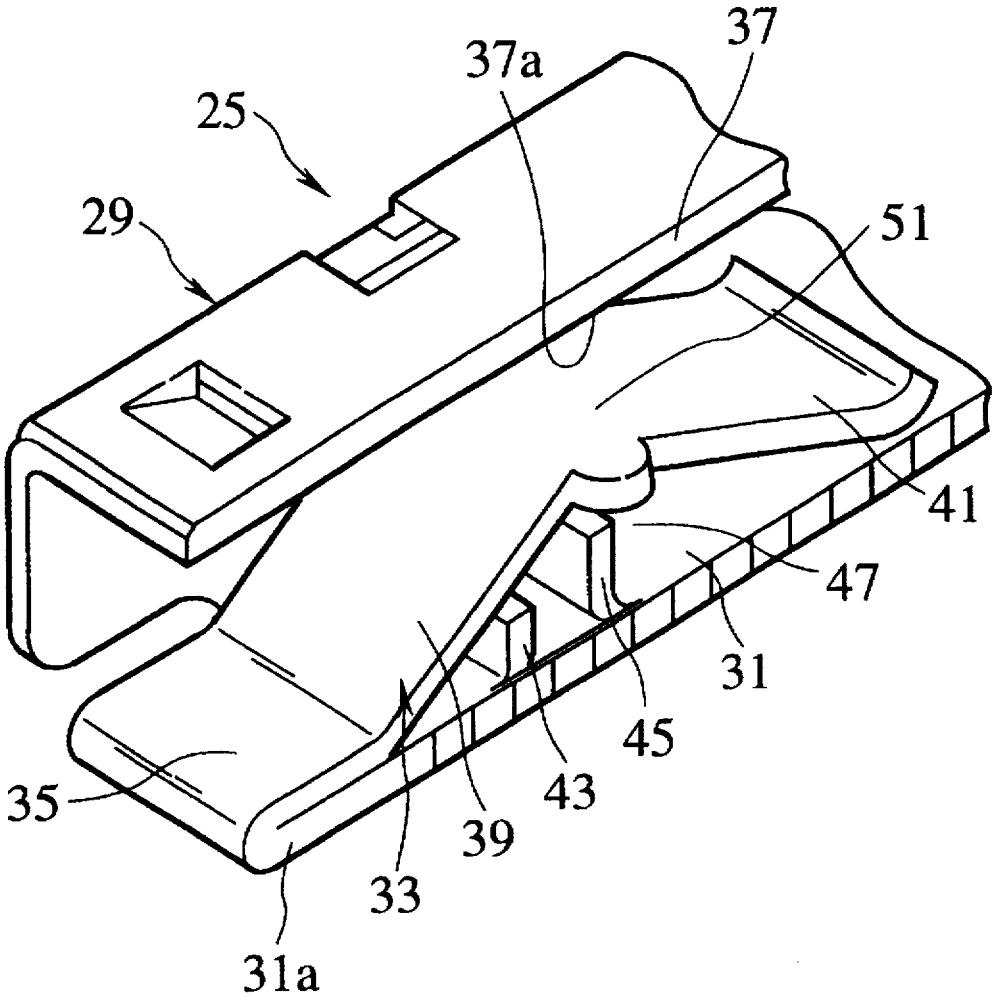
FIG. 1 is a perspective view of the preferred embodiment of a female terminal according to the present invention, a part of which is sectioned.

Referring now to the drawings, the preferred embodiment of a female terminal according to the present invention will be described below.

As shown in FIG. 1, a female terminal 25 is integrally formed with a hollow contact portion 29 of a substantially quadrangular cross-section on one side thereof and with an electric-wire connecting portion (not shown) on the other side thereof. A resilient contact piece 33 is formed by folding the tip portion of a bottom plate portion 31 of the hollow contact portion 29. This resilient contact piece 33 comprises a tip folded portion 35 formed by folding the tip portion of the bottom plate portion 31 so that the tip folded portion 35 is piled up on the bottom plate portion 31, a first piece portion 39 extending from the tip folded portion 35 toward an inner wall 37*a* of a roof plate portion 37 of the hollow contact portion 29 so as to be inclined upwards, and a second piece portion 41 extending from the tip portion of the first piece portion 39 toward the bottom plate portion 31 so as to be inclined downwards. The first piece portion 39 and the second piece portion 41 are associated with each other to form the resilient contact piece 33 so as to be angled like a chevron.

Figure 3:
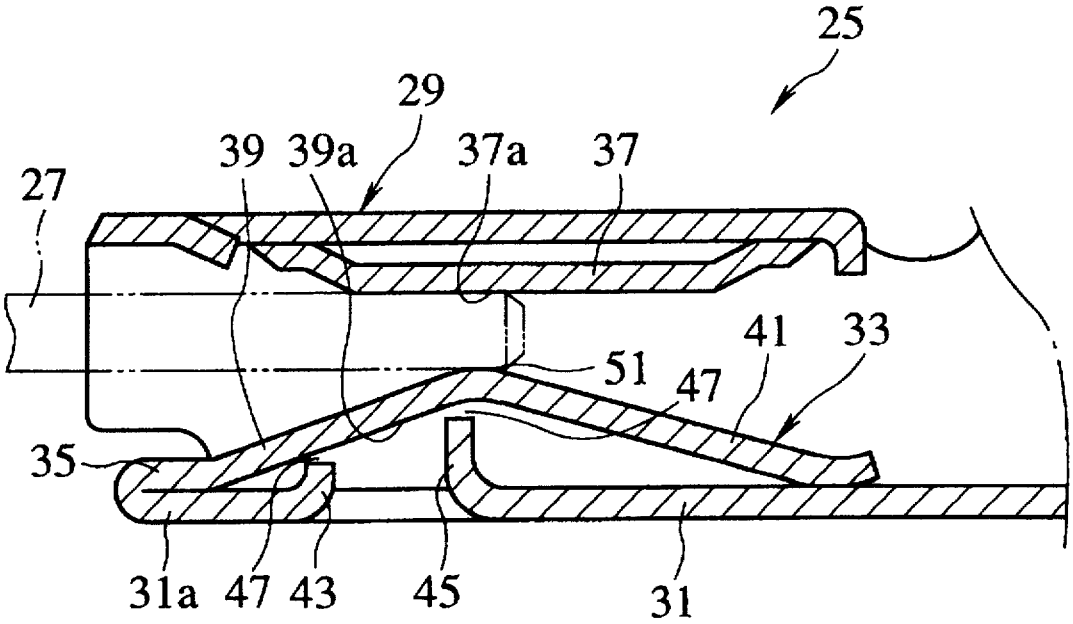
FIG. 3 is a sectional view of the female terminal of FIG. 1, which illustrates the state that a male terminal is inserted into a hollow contact portion of the female terminal having a substantially quadrangular cross-section.
Figure 4:
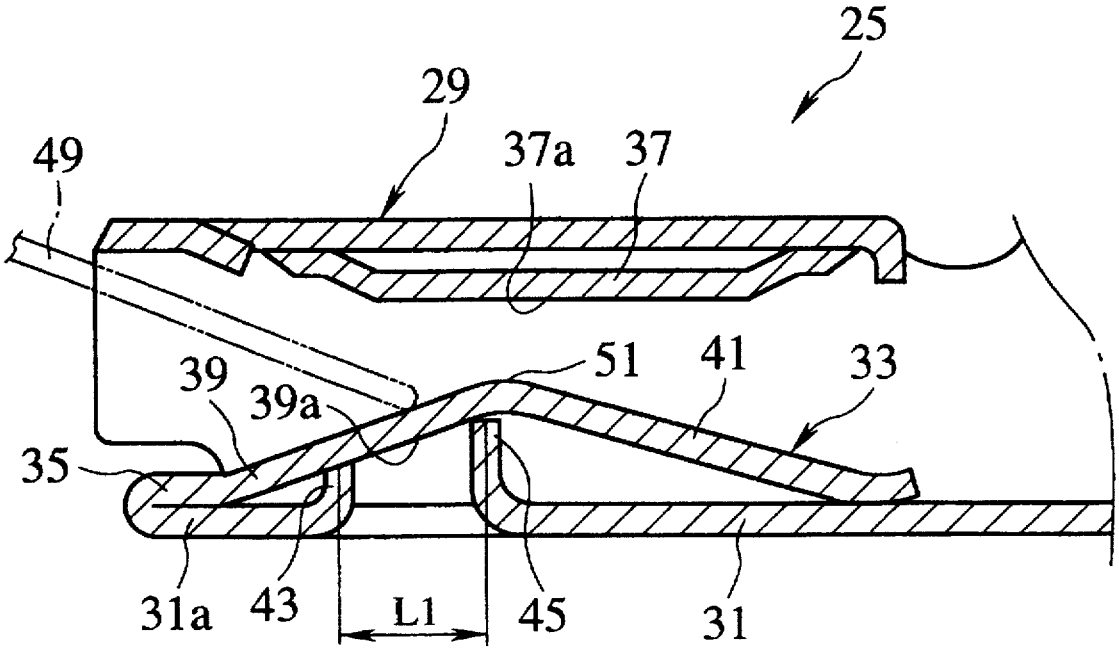
FIG. 4 is a sectional view of the female terminal of FIG. 1, which illustrates the state that the middle portion of a first piece portion is prized by a terminal extracting tool.

According to this preferred embodiment, the bottom plate portion 31 of the female terminal 25 is formed with a pair of protruding portions 43 and 45, on which the resilient contact piece 39 projecting toward the roof plate portion 37 is supported while maintaining the elastic deformation of the resilient contact piece 39. The protruding portions 43 and 45 are formed by bending portions cut out of the bottom plate portion 31 in directions perpendicular to the bottom plate portion 31 toward the hollow contact portion 29, so as to be apart from one another at an interval. The heights of the protruding portions 43 and 45 from the bottom plate 31 are set in accordance with the inclination of the first piece portion 39. As shown in FIG. 3, the height of the protruding portion 43 on the side of the tip folded portion 35 is so set as to form a gap 47 between the lower surface 39*a* of the first piece portion 39 and the tip of the protruding portion 43 when a male terminal 27 of a proper thickness is inserted into the hollow contact portion 29. As shown in FIG. 4, when the middle portion of the first piece portion 39 is prized by a terminal extracting tool 49 or the like, the protruding portion 43 contacts and supports the first piece portion 39 thereon while the elastic deformation of the first piece portion 39 is maintained.

In addition, the height of the protruding portion 45 on the side of the connecting portion of the first piece portion 39 to the second piece portion 41, i.e. on the side of the top portion 51 of the resilient contact piece 33, is also set so as to form the gap 47 between the lower surface 39*a* of the first piece portion 39 and the tip of the protruding portion 45 when the male terminal 27 of a proper thickness is inserted into the hollow contact portion 29. In addition, as shown in FIG. 4, when the middle portion of the first piece portion 39 is prized by the terminal extracting tool 49 or the like, the protruding portion 45 contacts and supports the first piece portion 39 thereon while the elastic deformation of the first piece portion 39 is maintained.

In this case, when the terminal extracting tool 49 or the like contacts the first piece portion 39, the protruding portions 43 and 45 are supporting points. If the distance L1 between the protruding portions 43 and 45 is set to be relatively short, the strength of the first piece portion 39 is increased so as to be difficult to be deformed.

The cases that the mating male terminal 27 is inserted into the hollow contact portion 29 and that a terminal extracting tool or a probe such as a tester is inserted into the hollow contact portion 29 to prize the interior thereof, will be described below.

As shown in FIG. 3, when the male terminal 27 of a proper thickness is inserted into the hollow contact portion 29, the male terminal 27 slides on the first piece portion 39 to be inserted between the first piece portion 39 of the resilient contact piece 33 and the roof plate portion 37 of the hollow contact portion 29. At this time, the first piece portion 39 is bent toward the bottom plate portion 31 so that the tip folded portion 35 serves as a base end. When the first piece portion 39 is bent toward the bottom plate portion 31, the tip portion of the second piece portion 41 contacts the bottom plate portion 31, and then, the second piece portion 41 is also bent due to the bending of the first piece portion 39 toward the bottom plate portion 31, so that the tip portion of the second piece portion 41 slides on the bottom plate portion 31 toward the rear end portion of the hollow contact portion 29. Then, the resilient contact piece 33 is deformed toward the bottom plate portion 31 in whole. In this case, there is the gap 47 between the tip portions of the protruding portions 43 and 45 and the lower surface of the first piece portion 39. Therefore, the male terminal 27 is pressed against the inner wall 37*a* of the roof plate portion 37 by a predetermined pressing force due to the elastic force of the resilient contact piece 33, so as to be elastically held between the inner wall 37*a* of the roof plate portion 37 and the resilient contact piece 33.

Then, the case that a terminal extracting tool is inserted into the hollow contact portion 29 to prize the interior thereof will be described. As shown in FIG. 4, when the terminal extracting tool 49 having a thickness of less than that of the male terminal 27 is inserted into the hollow contact portion 29 to contact the middle portion of the first piece portion 39 (in this case, the portion between the protruding portions 43 and 45), the first piece portion 39 is bent toward the bottom plate portion 31 to be supported on the tip portions of the protruding portions 43 and 45 while the elastic deformation of the first piece portion 39 is maintained. In this state, when the terminal extracting tool is wrenched, a force is applied to the middle portion of the first piece portion 39 by the terminal extracting tool 49. In this case, since the lower surface of the first piece portion 39 contacts the protruding portions 43 and 45 while the elastic deformation of the first piece portion 39 is maintained, the force is applied to the first piece portion 39 between the protruding portions 43 and 45 serving as supporting points. However, since the distance L1 between the protruding portions 43 and 54 is set to be relatively short, the strength of the first piece portion 39 is increased so as to be difficult to be deformed.

Figure 2:
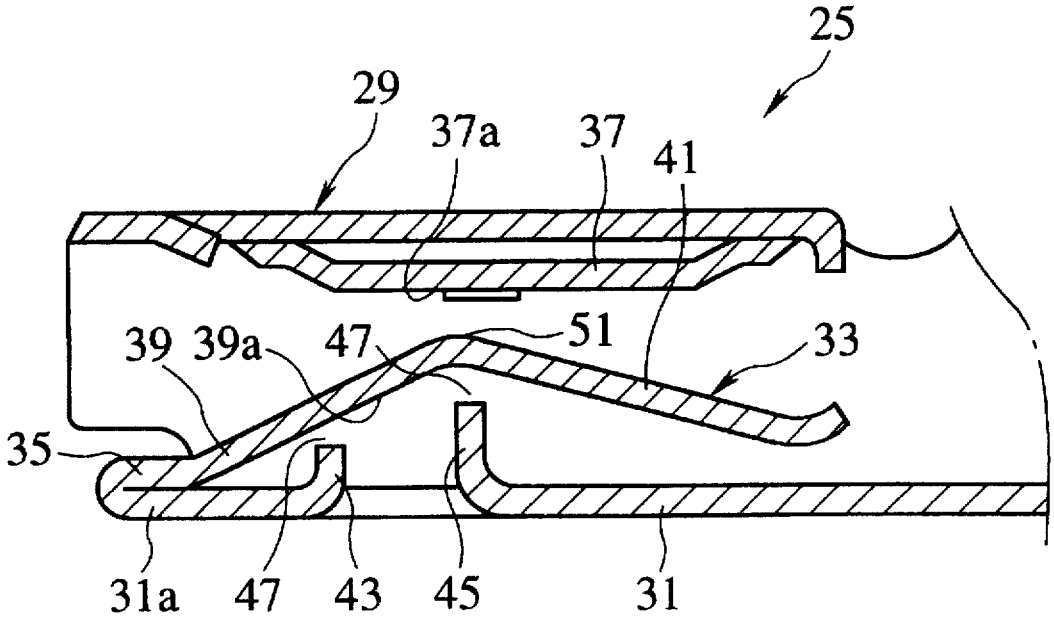
FIG. 2 is a sectional view of the female terminal of FIG. 1, which illustrates the interior of the female terminal.

Then, when the terminal extracting tool 49 is drawn out of the hollow contact portion 29, the first piece portion 39 supported on the protruding portions 43 and 45 while the elastic deformation is maintained is returned to the original shape as shown in FIG. 2. Therefore, from this state, when the male terminal 27 is inserted into the hollow contact portion 29, the male terminal 27 is elastically held in the hollow contact portion 29 as mentioned above.

According to this preferred embodiment, the bottom plate portion 31 is provided with the protruding portions 43 and 45, on which the first piece portion 39 is supported while the elastic deformation thereof is maintained, so that the resilient contact piece 33 is not plastic-deformed even if the middle portion of the first piece portion 39 of the resilient contact piece 33 is prized. In addition, it is possible to mold a small female terminal since the area supporting the first piece portion 39 may be small.

In addition, according to this preferred embodiment, since each of the protruding portions 43 and 45 are formed by bending a portion cut out of the bottom plate portion 31, it is possible to easily form the protruding portions 43 and 45 and to inexpensively manufacture the female terminal. In addition, unlike the conventional art, it is not required for the protruding portions to closely contact and support the lower surface of the first piece portion 39. Therefore, the required dimensional accuracy may not be so high, so that it is possible to decrease the manufacturing cost.

Furthermore, while two protruding portions 43 and 45 have been formed from the bottom plate portion 31 in this preferred embodiment, three protruding portions or more may be formed.

In addition, while each of the protruding portions 43 and 45 has been formed by bending a portion cut out of the bottom plate portion 31, separate protruding portions may be mounted on the bottom plate portion 31.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiment which can be embodied without departing from the principle of the invention as set forth in the appended claims.

What is claimed is:

1. A female terminal comprising:

a hollow contact portion of a substantially quadrangular cross-section for receiving a male terminal through an opening formed in a front end thereof, so as to establish an electrical connection between the male terminal and the female terminal, said hollow contact portion having a roof plate portion and a bottom plate portion;

a resilient contact piece, formed in said hollow contact portion by folding a tip portion of said bottom plate portion, for biasing said male terminal toward said roof plate portion, said resilient contact piece having a first piece portion which extends from said front end so as to be inclined upwards toward said roof plate portion; and a plurality of protruding portions extending from said bottom plate portion toward said roof plate portion, for supporting thereon said first piece portion while maintaining the elastic deformation of the first piece portion when an excessive force is applied to said first piece portion.

2. A female terminal as set forth in claim 1, wherein said plurality of protruding portions are so arranged as to be apart from each other at regular intervals in a longitudinal direction of said female terminal, each of said plurality of protruding portions having a height set in accordance with the inclination of said first piece portion.

3. A female terminal as set forth in claim 2, wherein each of said plurality of protruding portions is formed by bending a portion cut out of said bottom plate portion in a direction substantially perpendicular to said bottom plate portion.

4. A female terminal as set forth in claim 1, wherein said resilient contact piece has a second piece portion which extends from the tip of said first piece portion so as to be inclined downwards toward said bottom plate portion.

* * * * *